US011492157B2

(12) United States Patent
Hochstrasser et al.

(10) Patent No.: US 11,492,157 B2
(45) Date of Patent: Nov. 8, 2022

(54) STRAPPING APPARATUS HAVING A TENSIONING DEVICE

(71) Applicant: Signode Industrial Group LLC, Glenview, IL (US)

(72) Inventors: Samuel Hochstrasser, Fällanden (CH); Benjamin Hubschmid, Buchs (CH)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 17/395,048

(22) Filed: Aug. 5, 2021

(65) Prior Publication Data

US 2021/0362889 A1 Nov. 25, 2021

Related U.S. Application Data

(63) Continuation of application No. 16/478,642, filed as application No. PCT/US2018/015715 on Jan. 29, 2018, now Pat. No. 11,084,609.

(30) Foreign Application Priority Data

Jan. 30, 2017 (CH) ..... 00103/17

(51) Int. Cl.
*B65B 13/02* (2006.01)
*B65B 13/04* (2006.01)
(Continued)

(52) U.S. Cl.
CPC ..... *B65B 13/025* (2013.01); *B65B 13/04* (2013.01); *B65B 13/18* (2013.01); *B65B 13/22* (2013.01);
(Continued)

(58) Field of Classification Search
CPC ..... B65B 13/025; B65B 13/04; B65B 13/18; B65B 13/185; B65B 13/186; B65B 13/22;
(Continued)

(56) References Cited

U.S. PATENT DOCUMENTS 3,455,213 A 7/1969 Seragnoli
4,145,963 A 3/1979 Leslie et al.
(Continued)

FOREIGN PATENT DOCUMENTS

CH 707027 A2 * 3/2014 ..... B65B 13/025
CH 708328 A2 * 12/2014 ..... B65B 13/025
(Continued)

OTHER PUBLICATIONS

"International Search Report and Written Opinion", European Patent Office from corresponding PCT/US2018/015715 (12 pages), dated Apr. 4, 2018.
(Continued)

*Primary Examiner* — Stephen F. Gerrity
(74) *Attorney, Agent, or Firm* — Neal, Gerber & Eisenberg LLP

(57) ABSTRACT

The present disclosure provides a strapping apparatus for strapping articles to be packaged with a strapping band. The strapping apparatus includes a band detection device configured to indicate that the band is in a non-positionally correct and/or a positionally correct position, depending on the embodiment.

20 Claims, 5 Drawing Sheets

(51) Int. Cl.

| | |
|---|---|
| ***B65B 13/22*** | (2006.01) |
| ***B65B 13/32*** | (2006.01) |
| ***B65B 57/08*** | (2006.01) |
| ***B65B 57/18*** | (2006.01) |
| ***B65B 13/18*** | (2006.01) |

(52) U.S. Cl.
CPC ..... *B65B 13/322* (2013.01); *B65B 13/327* (2013.01); *B65B 57/08* (2013.01); *B65B 57/18* (2013.01)

(58) Field of Classification Search
CPC ..... B65B 13/24; B65B 13/32; B65B 13/322; B65B 13/327; B65B 57/08; B65B 57/18
USPC ..... 53/64, 508; 100/4, 29, 32, 33 PB
See application file for complete search history.

(56) References Cited

U.S. PATENT DOCUMENTS

| | | | | |
|---|---|---|---|---|
| 4,595,433 | A | 6/1986 | Ford et al. | |
| 5,632,851 | A | 5/1997 | Young | |
| 6,957,678 | B2 | 10/2005 | Scholl et al. | |
| 7,204,187 | B2 | 4/2007 | Zeimetz et al. | |
| 7,428,866 | B2 | 9/2008 | Reiche | |
| 9,272,799 | B2 | 3/2016 | Figiel et al. | |
| 9,468,968 | B2 | 10/2016 | Figiel et al. | |
| 9,630,265 | B2 | 4/2017 | Figiel et al. | |
| 10,308,383 | B2 | 6/2019 | Boss et al. | |
| 10,322,831 | B2 | 6/2019 | Nasiatka et al. | |
| 11,084,609 | B2 * | 8/2021 | Hochstrasser et al. | B65B 13/322 |
| 2003/0010223 | A1 | 1/2003 | Lopez | |
| 2004/0255552 | A1 | 12/2004 | Haberstroh et al. | |
| 2016/0376041 | A1 | 12/2016 | Skonieczny, Jr. et al. | |
| 2017/0008652 | A1 | 1/2017 | Figiel et al. | |
| 2017/0166335 | A1 | 6/2017 | Nasiatka et al. | |
| 2017/0174374 | A1 | 6/2017 | Figiel et al. | |

FOREIGN PATENT DOCUMENTS

| | | | | |
|---|---|---|---|---|
| CN | 1396091 | A | 2/2003 | |
| CN | 202783948 | U | 3/2013 | |
| CN | 105173166 | A | 12/2015 | |
| CN | 105324310 | A | 2/2016 | |
| CN | 105358433 | A | 2/2016 | |
| DE | 3904884 | A1 | 8/1990 | |
| DE | 102004012732 | B3 | 12/2004 | |
| EP | 1273520 | A1 * | 1/2003 | B65B 13/18 |
| GB | 2334769 | A | 9/1999 | |
| JP | H11292011 | A | 10/1999 | |
| JP | 3623525 | B2 | 12/2004 | |
| TW | 200410869 | A | 7/2004 | |
| TW | 201502012 | A | 1/2015 | |
| WO | WO-2009129634 | A1 * | 10/2009 | B65B 13/025 |
| WO | 2016209718 | A1 | 12/2016 | |

OTHER PUBLICATIONS

"Machine translation of Office Action", issued by CIPO in connection with CN201880006035.2, dated Oct. 10, 2020.

"Office Action", Corresponding Japanese Patent Application JP2019-539929 machine translation, dated Aug. 4, 2020.

"Official Letter and Search", from corresponding Taiwan patent application No. 107103730, with English translation (9 pages), dated May 21, 2021.

* cited by examiner

STRAPPING APPARATUS HAVING A TENSIONING DEVICE

PRIORITY

This application is a continuation of U.S. patent application Ser. No. 16/478,642, having a 371(c) date of Jul. 17, 2019, which is a national stage application of PCT/US2018/015715, filed on Jan. 29, 2018, which claims priority to and the benefit of Swiss Patent Application No. CH 00103/17, filed on Jan. 30, 2017, the entire contents of each of which are incorporated by reference herein.

FIELD

The present disclosure relates to a strapping apparatus for strapping articles to be packaged with a strapping band, said apparatus having a tensioning device for applying a band tension to a loop of the strapping band, wherein the tensioning device is provided with a tensioning element that is provided to apply a band tension and to engage in the strapping band and is drivable in rotation, and having a closure device for creating a permanent connection, in particular a welded connection, at two regions, located one on top of the other, of the loop of the strapping band.

BACKGROUND

Strapping apparatuses of this kind are used to strap articles to be packaged with a plastics or steel band. To this end, a loop of the particular strapping band is placed around the article to be packaged. Usually, the strapping band is drawn off a supply roll in this case. Once the loop has been placed fully around the article to be packaged, the end region of the band overlaps a portion of the band loop. The portable and mobile strapping apparatus is now brought into abutment against this two-layer region of the band, in the process the band is clamped in the strapping apparatus, the band loop is applied to the article to be packaged in a tight manner by way of the tensioning device, and in the process the band loop is provided with band tension. Subsequently, the band loop is closed, for example by a welded joint on the band or by attaching a closing seal. Thereafter, or approximately at the same time, the band loop is separated from the supply roll. As a result, the particular article to be packaged is strapped and generally ready for dispatch.

Strapping apparatuses of the generic type are provided for mobile use, in which the appliances should be carried along to the particular point of use by a user and preferably not be dependent on the use of an external power supply there. The energy required for the intended use of such strapping appliances in order to tension a strapping band about any desired article to be packaged and to create a closure is generally provided, in previously known strapping appliances, by an electric battery or by compressed air. With this energy, the band tension applied to the band by way of the tensioning device and a closure on the strapping band are created. Strapping apparatuses of the generic type are additionally provided to connect only weldable plastics bands together.

In the case of portable mobile strapping appliances, the band has to be introduced into the strapping apparatus manually. In order that both the tensioning device and the closure device can carry out their functions as intended, it is necessary that the strapping band be located in a predetermined position in the strapping apparatus, both in the tensioning device and in the closure device. The band should thus be arranged with regard to the tensioning device and closure device, usually arranged in succession in the band running direction, such that both the tensioning device and the closure device of the strapping apparatus receive the band between one another in each case between lower and upper components of these devices and in the process capture the band in each case over the entire band width thereof. In particular since mobile strapping appliances are often used in a harsh production environment and under piecework conditions, there is the risk of the band not being introduced into the strapping apparatus in a positionally correct manner and yet an attempt being made to carry out band strapping. This generally results in substandard strapping, if strapping can be carried out in full in the first place. Such strapping can in particular have insufficient band tension and/or inferior closures, which cannot stand up to the loads that occur, and fail. Since such strapping serves as a way for securing articles to be packaged and loads, when the strapping fails, this may result in damage to the load or even injuries to persons. Strapping bands that are not arranged in accordance with an intended orientation in the strapping apparatus while band strapping is being carried out thus represent a serious problem.

BRIEF SUMMARY

Therefore, the present disclosure is based on the object of preventing as far as possible, in strapping apparatuses of the type mentioned at the beginning, the consequences that have previously occurred of strapping bands that are not arranged in accordance with an intended orientation in a strapping apparatus, in order as far as possible to prevent failure of band straps resulting from such an erroneous arrangement of the strapping bands.

In the case of a strapping apparatus of the type mentioned at the beginning, this object is achieved according to the present disclosure by band detection mechanisms, by way of which a positionally correct position of the strapping band in the strapping apparatus is detectable, and by signaling mechanisms, by way of which a positionally correct position of the strapping band on the strapping appliance is able to be signaled.

The present disclosure is therefore based on the idea of not even carrying out strapping operations with non-positionally correct arrangements of strapping bands in strapping apparatuses and to avoid these in that the operator of the strapping apparatus is informed about the non-positionally correct arrangement of the strapping band in the strapping apparatus before the strapping operation is carried out. On account of such a warning or information at the strapping appliance, an operator of the strapping apparatus is informed, before carrying out a strapping operation, that a correction of the orientation of the strapping band in the strapping apparatus should be carried out. Therefore, on the basis of this information, the operator can correct the position of the strapping band in accordance with a predetermined intended position. Signaling can take place visually, acoustically, by vibration or in some other suitable way at the strapping appliance when a positionally correct position of the strapping band in the strapping apparatus has been reached. A non-positionally correct position of the band can either not be signaled at all or be signaled in a different way than the positionally correct position. Alternatively and likewise preferably, it is also possible for mechanisms to be provided, with which a non-positionally correct position of the strapping band is signaled. In this case, too, it is possible for a positionally correct position not to be signaled at all or to be signaled in some other perceptible way than the non-positionally correct position. The strapping operation can thus preferably be started as soon as the strapping apparatus signals such a position for the introduced strapping band. As a result, the functional reliability and thus also the quality of band straps of such strapping apparatuses can be improved considerably. Since, in this way, faulty strapping is also avoided, the present disclosure also contributes toward avoiding damage to articles to be packaged or injuries to persons on account of incorrect strapping. Furthermore, it is also possible, as a result, to reduce the consumption of strapping bands, since faulty strapping and the associated consumption of band material can be avoided.

In an embodiment of the present disclosure, provision may be made for the band detection mechanisms to comprise at least one contact mechanism which is in contact with the strapping band only in the positionally correct position of the strapping band, such that, as a result of this contact, it causes the signaling mechanism to display a positionally correct taking up of position. Alternatively, provision may also be made for the contact mechanism to be in contact with the strapping band only in the event of a non-positionally correct band position. Such a solution, which requires physical contact or elimination of the contact of the band with at least one contact mechanism in order for the reaching of the positionally correct position of the band in the strapping appliance to be signaled, provides particularly high functional reliability of the band detection mechanism. In addition, such a solution can be realized with little technical effort and thus in a particularly cost-effective manner.

The abovementioned embodiment of the present disclosure can be advantageously developed by an arrangement of the at least one contacting mechanism on the strapping apparatus, by way of which the contacting mechanism carries out a movement upon introduction of the strapping band into a positionally correct position in the strapping apparatus. Preferably, the movement or the associated change in position of the at least one contacting mechanism can be used directly or indirectly to signal a positionally correct position of the band on the strapping appliance. Such a movement may be in particular a pivoting movement of the contacting mechanism. Preferably, to this end, the contacting mechanism has at least one pivotable lever which, when the strapping band is put into a positionally correct position, carries out a pivoting movement about a pivot axis. Rectilinear movements or superpositions of rectilinear and curved movements of the contacting mechanism can also be provided as an alternative thereto.

An embodiment of the present disclosure, in which a movement of the contacting mechanism on account of a positionally correct position of the strapping band results in a movement of at least one element of the signaling mechanism, with the result that a display mechanism of the signaling mechanism signals a positionally correct position of the strapping band, contributes toward particularly low technical effort and yet high functional reliability. It may be particularly preferable here for the display mechanism and the contacting mechanism to be connected together, in particular configured integrally with one another. In such an embodiment of the present disclosure, triggering of the contacting mechanism inevitably also results in a predetermined movement of the display mechanism, which, as a result, signals, for example in an acoustic or visual manner, an actual orientation, given in accordance with an intended orientation, of the inserted band, or initiates such signaling.

In another embodiment of the present disclosure, the band detection mechanism, in addition to detecting positions of the strapping band, can also be used to keep at least a portion of the strapping band in a positionally correct position for the duration of the creation of strapping, or to guide the strapping band. To this end, in particular a movable band detection mechanism may be part of a band channel, in particular a lateral guide of this band channel, by way of which an intended orientation of the strapping band in the strapping apparatus is definable and the strapping band is able to be held in this position. With such a solution, it is thus possible to contribute actively—and not just by way of information about the band orientation—to the creation of high quality strapping.

In a further embodiment of the present disclosure, a positionally correct position of a strapping band can be determined contactlessly. To this end, at least one sensor may be provided in the strapping apparatus, said sensor detecting, in particular contactlessly detecting, the band as being present in a positionally correct position at least one point of the latter. When such a presence is determined, the at least one sensor can send a corresponding signal to the controller of the strapping apparatus. The controller can then cause a signaling mechanism to signal the positionally correct presence visually, acoustically, by vibration and/or in some other suitable way. The signal of the at least one sensor can also alternatively be supplied directly to such a signaling mechanism. Alternatively, a sensor can also be used to detect an absence or non-presence of the strapping band on its intended course in the strapping apparatus. This detection result can be supplied in the form of a signal to the controller of the strapping apparatus, with the result that the controller prevents or does not enable a start of a strapping cycle, in particular a welding operation on the band. Provision can likewise be made, on the basis of the detection signal, for a visual and/or acoustic warning signal to be output by the strapping apparatus in the event of a non-positionally correct arrangement and/or for a visual and/or acoustic enabling signal to be output by the strapping apparatus in the event of a positionally correct arrangement.

In a further embodiment of the present disclosure, a mechanism may be provided with which triggering of the tensioning operation—and optionally the triggering of a complete strapping operation—is enabled at the strapping apparatus only when the band detection mechanism detect(s) a positionally correct arrangement of the strapping band. In band detection mechanism, which are based on contact with the strapping band, it is possible for example for a movement or change in position of the band detection mechanism to be used for enabling purposes, in order as a result to actuate for example an enabling mechanism configured as a switch. Such a solution can be realized with particularly little additional technical effort. In contactless band detection mechanism based on at least one sensor, a sensor signal can preferably be used to enable the tensioning operation.

Further configurations of the present disclosure can be gathered from the claims, the description and the drawing.

BRIEF DESCRIPTION OF THE SEVERAL VIEWS OF THE DRAWING

The present disclosure is explained in more detail on the basis of exemplary embodiments illustrated purely schematically in the figures, in which.

DETAILED DESCRIPTION

Figure 1:
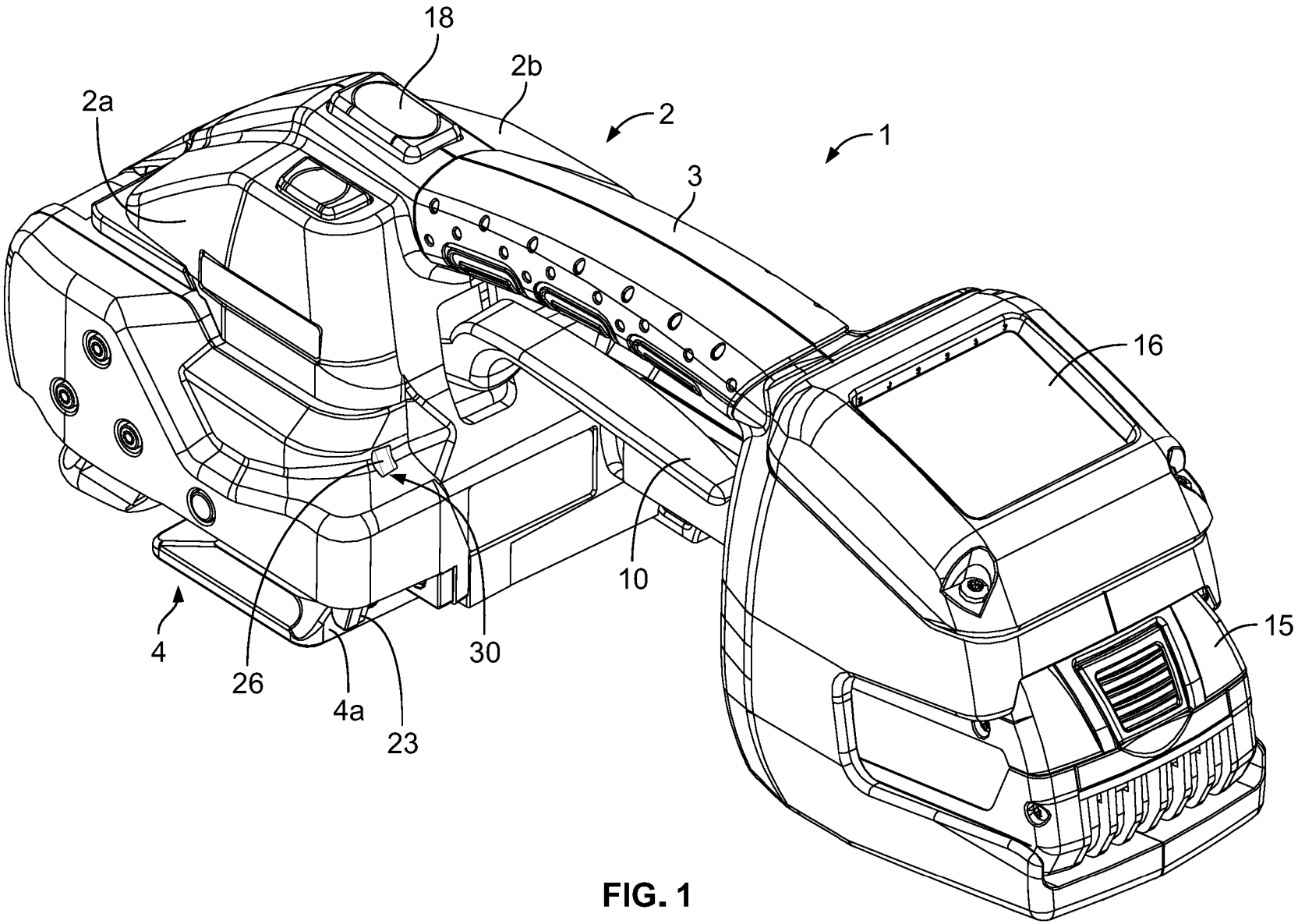
FIG. 1 shows a perspective illustration of an example strapping appliance according to the present disclosure, which is provided with a band detection mechanism and in which a hand lever, for preparing the strapping appliance for the introduction and extraction of a strapping band, is located in an intermediate position.

The strapping appliance 1 shown in FIGS. 1 to 4 is mentioned only by way of example for the present disclosure. The description of the specific configuration of the features of the strapping appliance 1 according to the present disclosure that is explained below serves merely for the understanding of the present disclosure and does not represent any limitation to embodiments of the present disclosure which would necessarily have to have the following features.

The manually actuated strapping appliance 1 according to the present disclosure that is illustrated here by way of example has a housing 2 which surrounds, inter alia, the mechanism of the strapping appliance and on which a handle 3 for handling the appliance is formed. The strapping appliance is furthermore provided with a base plate 4, the underside of which is provided for arrangement on an item to be packaged. All of the functional units of the strapping appliance 1 are fastened to the base plate 4 and to the carrier (not illustrated in more detail) of the strapping appliance, said carrier being connected to the base plate 4.

With the strapping appliance 1, a loop (not illustrated in more detail in FIG. 1) of a plastic band B, made for example of polypropylene (PP) or polyester (PET), which has previously been placed around the item to be packaged, can be tensioned by way of a tensioning device 6 of the strapping appliance. In other embodiments of the present disclosure, it is also possible for bands made of other materials, in particular of other plastics or other metal materials, to be processed, wherein, in these embodiments, the particular strapping appliance can be adapted to the band material provided in each case. The tensioning device 6 of the strapping appliance shown here has a tensioning wheel 7, a tensioning mandrel or other tensioning element, covered by the housing 2 in FIG. 1, of the tensioning device 6, with which the band B can be captured for a tensioning operation. The tensioning wheel 7 cooperates with a tensioning plate 8 such that the strapping band is able to be clamped between the tensioning wheel 7 and the tensioning plate 8 in order to tighten the strapping band loop, in particular while the tensioning wheel 7 is being driven in rotation, and during this movement, by engagement in the strapping band and retraction thereof, places the latter against the article to be packaged in each case and provides the band of the band loop with band tension.

In the exemplary embodiment, the tensioning plate 8 is arranged on a pivotable rocker 9, which can be pivoted about a rocker pivot axis. By way of a pivoting movement of the rocker 9 about the rocker pivot axis, the tensioning plate 8 can be transferred from an end position at a distance from the tensioning wheel 7 to a second end position in which the tensioning plate 8 is pressed against the tensioning wheel 7. By way of a corresponding motor-driven or manually driven movement in the opposite direction of rotation about the rocker pivot axis, the tensioning plate 8 can be moved away from the tensioning wheel 7 and pivoted back into its starting position, with the result that the band located between the tensioning wheel 7 and the tensioning plate is released for removal. In other embodiments of the present disclosure, it is also possible for the tensioning wheel 7 to be arranged on the movable, in particular pivotable, rocker 9 and for the tensioning plate 8 to be arranged in a fixed position.

When the shown embodiment of a tensioning apparatus is in use, provision is made for two layers of the strapping band to be located between the tensioning wheel 7 and the tensioning plate 8 and to be pressed against the tensioning plate 8 by the tensioning wheel 7 or against the tensioning wheel 7 by the tensioning plate. By rotation of the tensioning wheel 7, it is then possible for the band loop to be provided with a band tension which is high enough for packaging purposes.

Subsequently, welding of the two layers can take place, in a manner known per se, by way of the friction welding and separating device 12 of the strapping appliance at a point of the band loop at which two layers of the band are located one on top of the other. As a result, the band loop can be permanently closed. In various exemplary embodiment shown, the friction welding and separating device 12 is arranged behind the tensioning device in the direction of the provided tensioning direction, i.e. the direction in which the band is retracted by the tensioning device 6. In the exemplary embodiment, the friction welding and separating device 12 is additionally arranged at a distance from the tensioning device 6. In various exemplary embodiment shown here, the friction welding and separating device 12 can be driven by the same only one motor of the strapping appliance, with which all other motor-driven movements are also carried out. For this purpose, a freewheel (not illustrated in more detail) is provided in a manner known per se in the transmission direction from the motor to the points at which the motorized drive movement is used for band processing, said freewheel having the effect that the drive movement is transmitted in the drive direction of rotation, provided in each case for this purpose, to the corresponding functional unit of the strapping appliance 1, and no transmission takes place in the other drive direction of rotation, provided in each case for this purpose, of the motor. Solutions for such single-motor arrangements are previously known for example from the applicant's strapping appliance OR-T 250.

The friction welding device 12 is provided with a welding shoe 14 (not illustrated in more detail) which is transferred, by way of a transfer device 13, from a rest position at a distance from the band into a welding position in which the welding shoe 14 is pressed against the band. The welding shoe 14, which is pressed against the strapping band by mechanical pressure in the process, and the simultaneously performed oscillating movement of the welding shoe 14 with a predetermined frequency, cause the two layers of the strapping band to melt. The locally plasticized or molten regions of the band B flow into one another and, after the band B has cooled, a connection between the two band layers is then formed. If necessary, it is then possible for the band loop to be separated from a supply roll of the band by way of a cutting element (not illustrated in more detail) of the friction welding and separating device 12 of the strapping appliance 1.

The rotary drive of the tensioning wheel 7 about its tensioning axis, the infeed of the friction welding device 12 by way of the transfer device 13, and also the use of the friction welding device 12 per se, and the actuation of the separating device, take place using only one common electric motor, which provides a drive movement for each of these components of the strapping appliance. For the power supply of the motor, an exchangeable battery 15, which is removable and exchangeable in particular for charging purposes, and which serves for storing electrical energy, is arranged on the strapping appliance. Other external auxiliary energy, such as compressed air or further electricity, for example, may be supplied, but this does not take place in the case of the strapping appliance according to FIGS. 1 and 2. In other embodiments of the present disclosure, however, it is also possible for other forms of energy, in particular compressed air, rather than electrical energy, to be utilized as drive energy. Likewise, in other embodiments of the present disclosure, it is also possible for a plurality of motors for driving the functional units to be provided.

Figure 3:
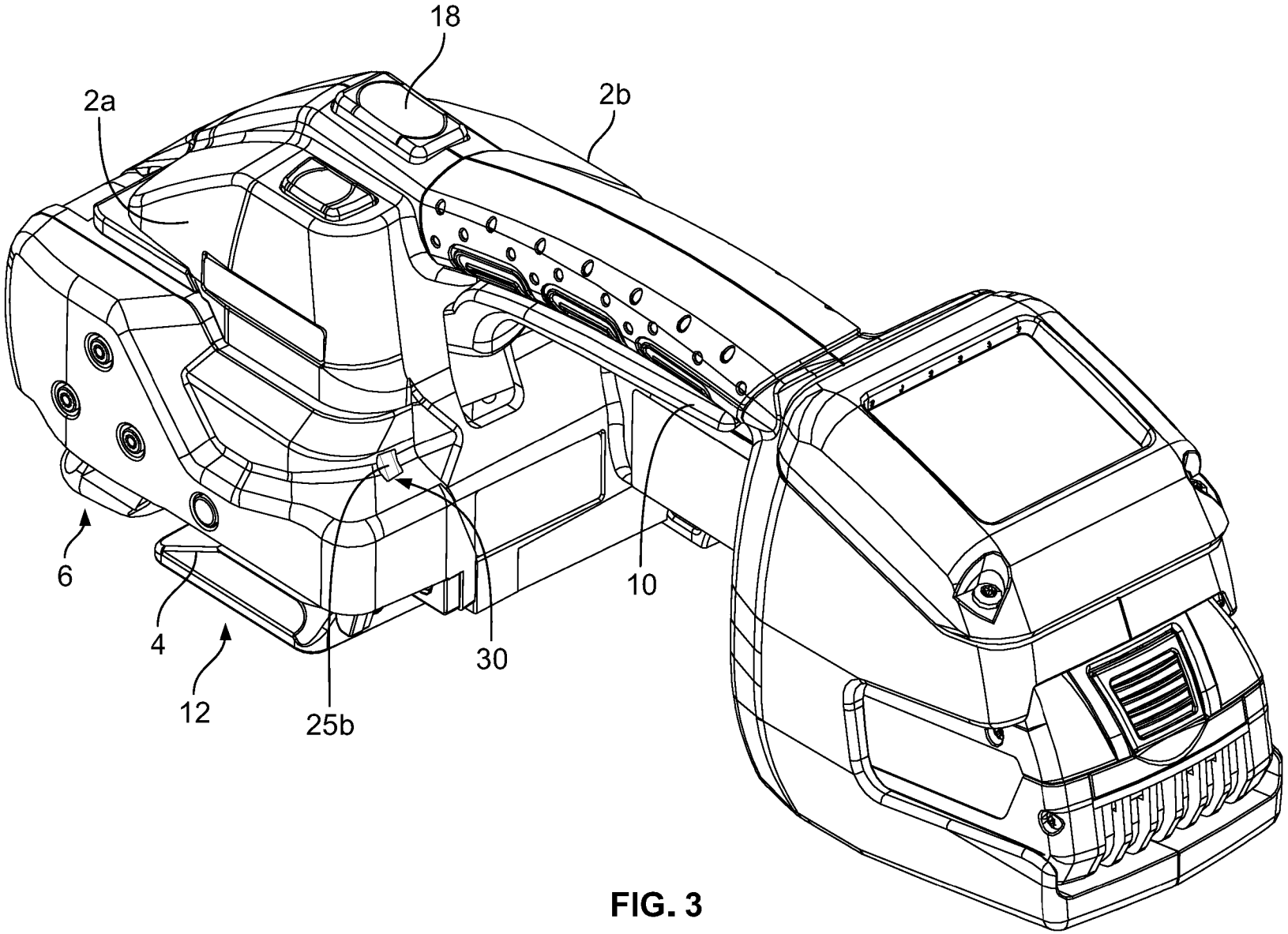
FIG. 3 shows the strapping appliance in FIG. 1 with the hand lever in an upper end position in which, by way of the hand lever, the strapping appliance is prepared for the removal and introduction of the strapping band.
Figure 4:
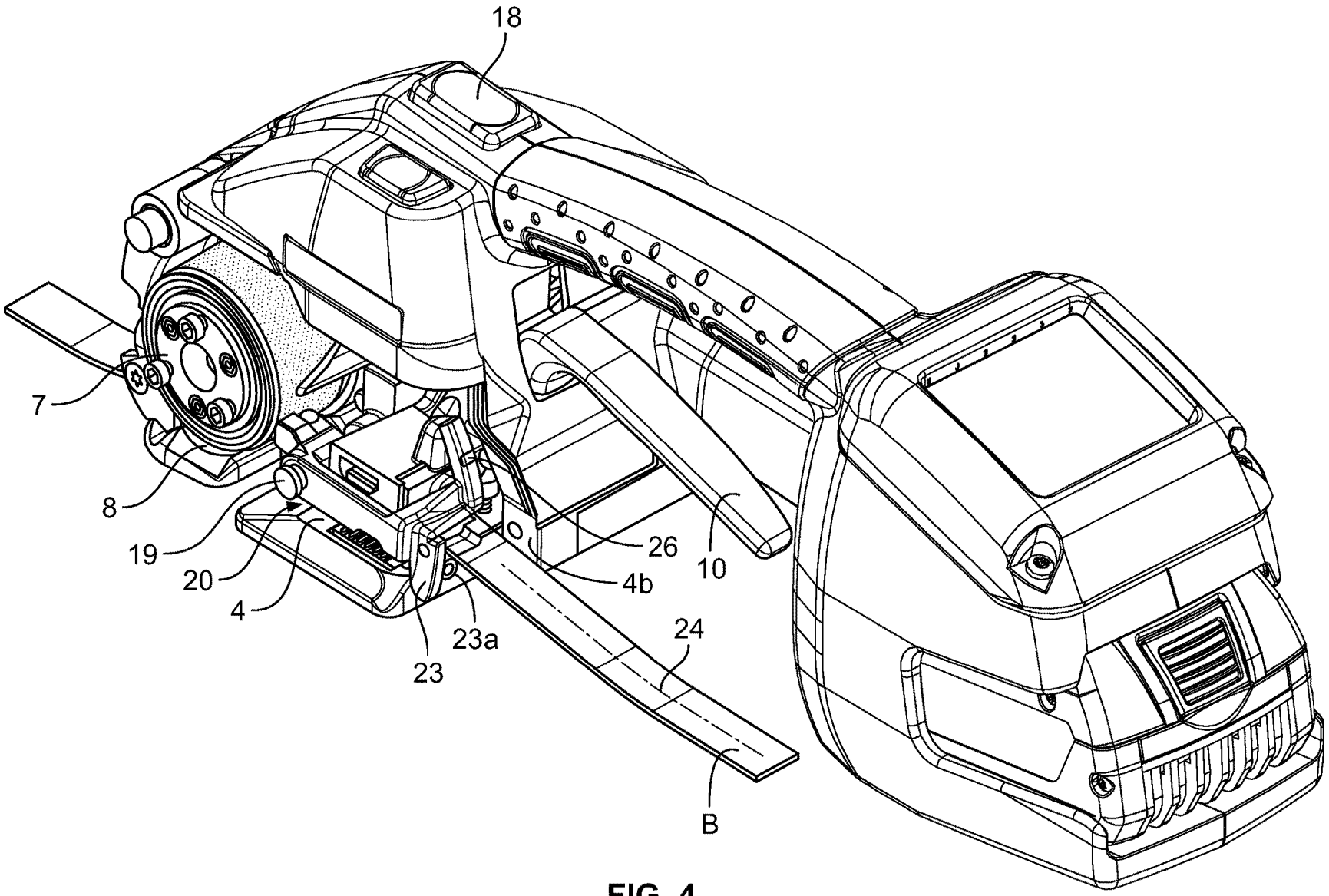
FIG. 4 shows the strapping appliance in FIG. 1 in a state of the band detection mechanism that the latter takes up with a strapping band inserted in a positionally correct manner and in which the hand lever is located in a lower end position.
Figure 5:
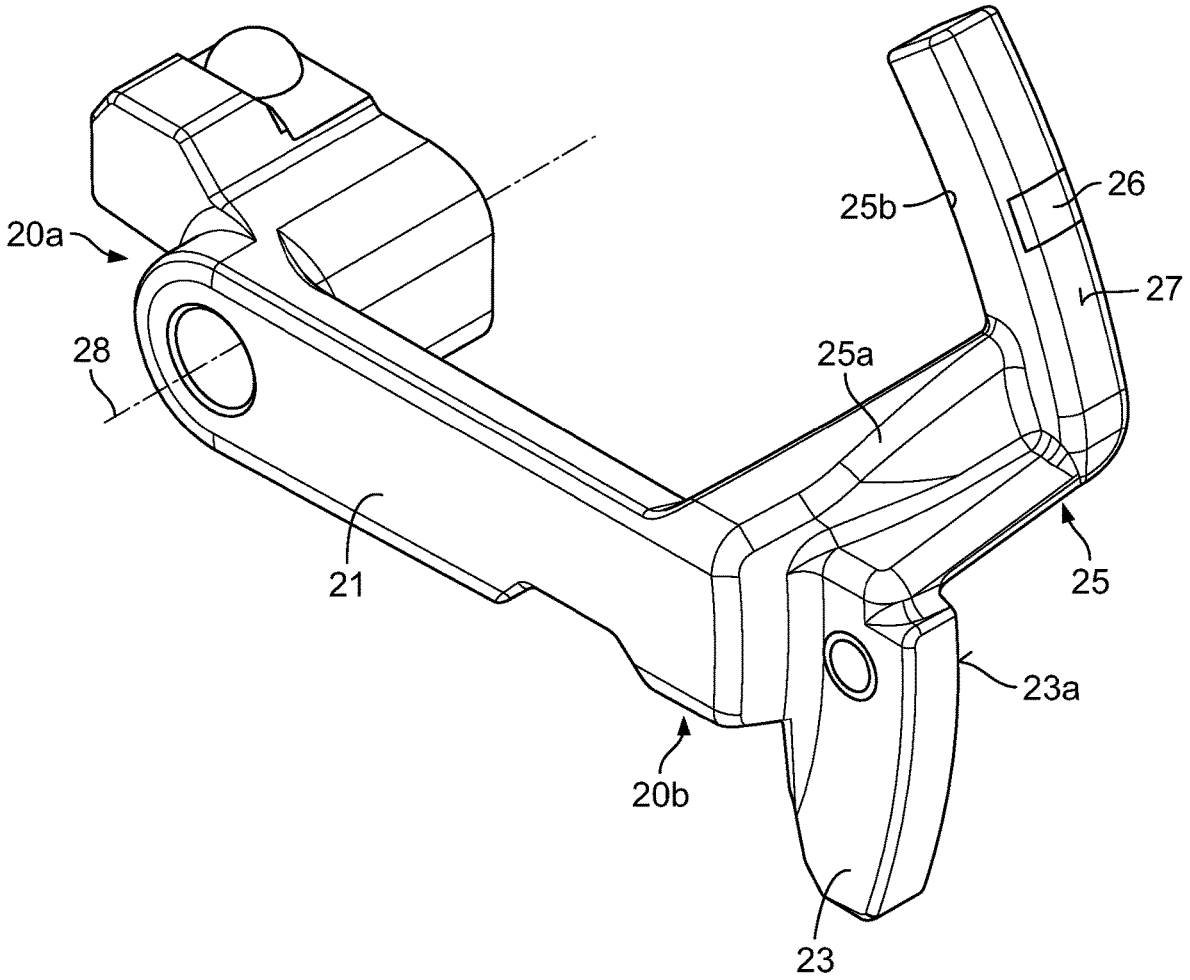
FIG. 5 shows the band detection mechanism of the strapping appliance in FIGS. 2 and 4.

In order to create, between the tensioning wheel 7 and the tensioning plate 8, a gap for releasing a band located therein and for the removal thereof and the introduction of a new band or band portion, a hand lever 10 is actuated. The starting position of the hand lever, namely a lower end position, is illustrated in FIG. 4. In this position, the tensioning plate 8 and the tensioning wheel 7 clamp a band inserted into the strapping appliance between one another. In order to create a sufficiently large gap between the tensioning wheel 7 and the tensioning plate for the removal of the band B, the hand lever 10 is pulled manually in the direction of the handle 3 into its upper end position (FIG. 3). As a result, the tensioning plate 8 arranged on a rocker pivots away from the tensioning wheel 7. In other embodiments of the present disclosure, it is also possible for the tensioning wheel 7 to be articulated in a pivotable manner via the hand lever 10. FIG. 3 shows the state of the hand lever 10 pivoted out of its neutral position (see FIG. 4), in which the maximum distance between the tensioning wheel 7 and the tensioning plate 8 for band extraction and introduction is created. After the (new) band has been inserted, the hand lever 10 spring-preloaded in this position is released again, with the result that the rocker with the tensioning plate 8 is pivoted back against the tensioning wheel and as a result the band is clamped. The infeed of the tensioning plate 8 or of the tensioning wheel 7 in the direction of the respectively other element of the tensioning device likewise takes place via manual actuation of the hand lever 10. Ideally, after being released, the hand lever 10 takes up the starting position shown in FIG. 4 again, in which the band B has been inserted in a positionally correct manner and clamped.

The mobile portable strapping appliance 1 of the example embodiment illustrated in the figures has three different operating modes. The first mode is an automatic mode in which a complete strapping operation is triggered only by actuating a button 18 or some other switch element. In this automatic mode, after triggering, first of all a tensioning operation by way of the tensioning device 6 and, directly thereafter, a connection between the two band layers of the band loop are formed. Likewise automatically, the band of the loop is separated from the band supply by way of a separating device.

A second mode is a semi-automatic mode. This too, like the automatic mode, can be set by selection by way for example of a button, a switch or a control panel 16. In this case, the tensioning operation and the creation of a connection are each initiated one after the other by the operator. The tensioning operation is maintained for as long as the operator actuates the button 18 or other operating element provided for maintaining the tensioning operation. However, the tensioning operation is maintained at the longest until a preset maximum band tension has been achieved. When the set maximum band tension is achieved, the tensioning operation is ended and the strapping appliance switches automatically into the connecting mode and carries out the connecting operation. As soon as a button or other operating element provided for triggering the connecting operation is actuated, the connecting device is initiated. The separation of the band from the supply can take place together with the creation of the connection. If the operator of the strapping appliance were to decide to stop the tensioning operation before the set maximum tensile stress or tensioning force has been achieved, for example because of the observation that a further increase in the band tension will result in damage to the article to be packaged, he can end the tensioning operation by releasing the actuating element 18 in the semi-automatic mode. By way of a subsequent actuation of an actuating element appropriate for the connecting device, the connecting device can then be triggered. In this case, both to trigger the tensioning operation and to trigger the connecting operation, it is thus in each case necessary for the operator to actuate a switch, or a button or some other actuating element.

Finally, a third operating mode is possible, namely a manual mode, which is likewise selectable and settable. In this case, the tensioning operation and the creation of the connection each have to be triggered separately from one another via one or more actuating elements 18. In the exemplary embodiment illustrated, the tensioning device 6 is able to be triggered by way of the actuating element 18 and is maintained for as long as the actuating element 18 is actuated. Just as in the semi-automatic mode, it is also possible here for the tensioning operation to be interrupted and to be continued by actuation of the button 18 until the set band tension to be achieved has also actually been achieved. As soon as the set band tension has been achieved, the controller turns off the tensioning device. The connecting device is preferably initiated by actuation of a further button. Following initiation, the connecting operation is then carried out in full, without a further actuation of an actuating element being necessary for this purpose.

Figure 2:
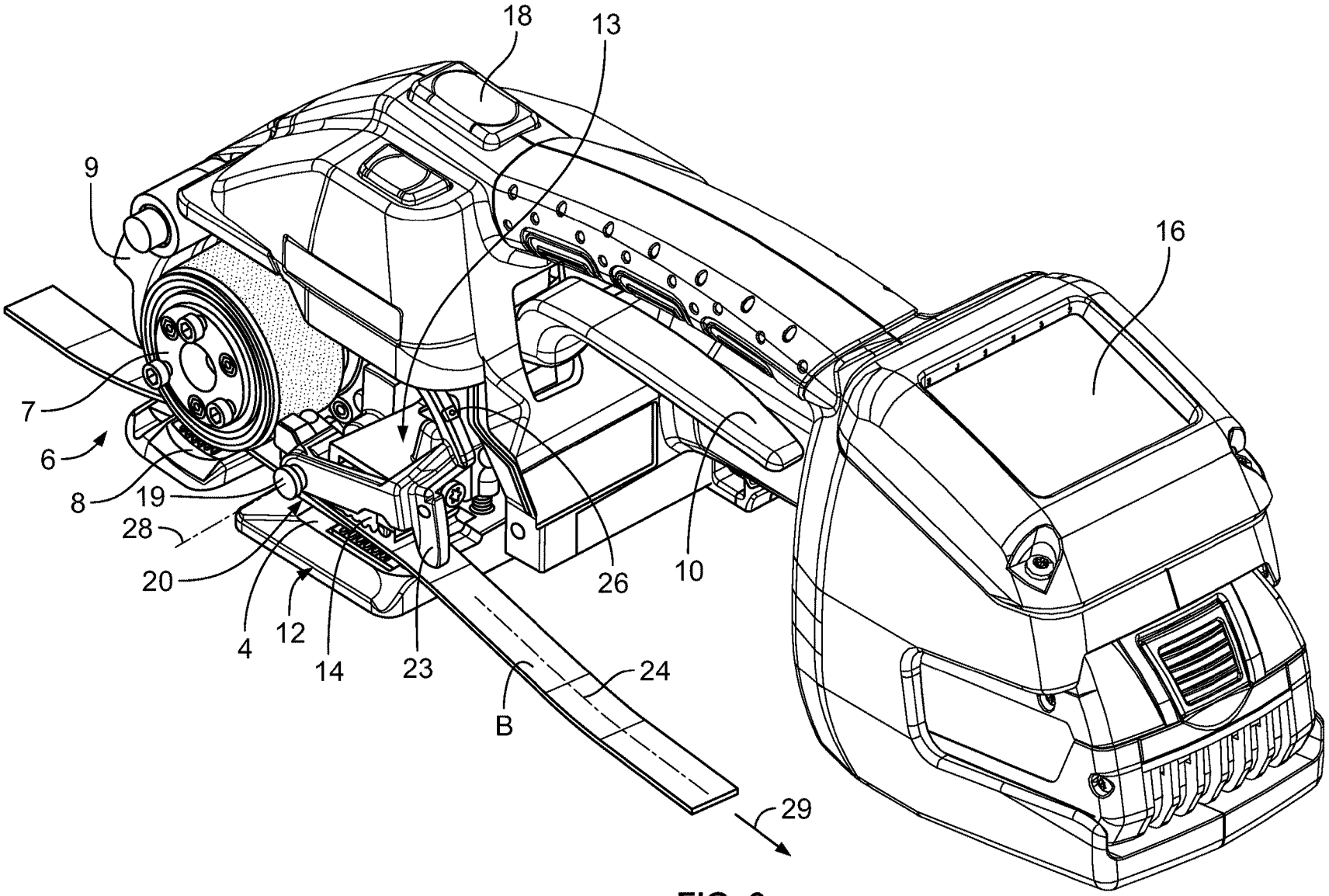
FIG. 2 shows the strapping appliance according to the present disclosure in FIG. 1 with a strapping band inserted in a non-positionally correct manner and a housing partially removed in the region of a tensioning device and a closure device of the strapping appliance, as a result of which the band detection mechanism is discernible.

As is illustrated in FIG. 2, the strapping appliance has a bearing shaft 19 arranged—with regard to the provided centerline 24—between the tensioning wheel and the friction welding and separating device 12. A band detection mechanism 20 is arranged in a pivotable manner on the bearing shaft 19. In the example exemplary embodiment, the band detection mechanism 20 is configured as a mechanical band detection mechanism, namely as a lever-like band detection mechanism. The band detection mechanism 20 is pushed by way of one of its ends 20*a* onto the bearing shaft 19. The bearing shaft 19 is arranged on a carrier of the strapping appliance and in this case projects between the tensioning wheel 7 and the welding shoe 14 via the provided intended position for the strapping band B in the strapping appliance. The band detection mechanism 20 provided here has a first lever-like portion 21, which extends approximately parallel to and at a distance from the provided centerline 24. Located on an underside, facing the strapping band, of the first lever-like portion 21, in the region of the other end thereof, is a hammer-head-like contact lug 23, which protrudes in the direction of the strapping band. A tip of the hammer-head-like contact lug 23 is intended to be in contact with the top side of a strapping band B introduced into the strapping appliance in a non-positionally correct manner.

In the exemplary embodiment illustrated, a side face 23*a* of the contact lug 23 additionally serves as a band guide for a strapping band inserted in a positionally correct manner into the strapping appliance (see FIG. 4). The band detection mechanism 20 forms, together with the base plate 4 and a boundary surface 4*b* located opposite the contact lug 23, a kind of band channel, the width of which corresponds at least substantially to the width of the strapping band B. A longitudinal direction of this band channel in this case defines an intended orientation for the strapping band B while the band strapping is being carried out.

A second lever-like portion 25 adjoins likewise in the region of the free end 20*b* of the lever-like portion 21. The second lever-like portion 25 is integrally connected to the first lever-like portion 21 and encloses an obtuse angle therewith. The second lever-like portion 25 is provided with a kink, such that the second lever-like portion itself has two segments 25*a*, 25*b*, which likewise in turn enclose an acute angle with one another. That segment 25*b* of the second lever-like portion 25 that is provided with the free end is provided on its outer side 27 with a marking 26. The outer side 27 can be understood here as meaning that side of the second portion 25 that faces away from an axis of rotation 28 formed by the bearing shaft 19. This marking 26 can be for example a surface region with a color contrasting with the color of the surface of the second portion 25, in particular a region of this type with a particular geometric shape. In the exemplary embodiment illustrated, the marking 26 is a red rectangle, which has been applied to a black background of the second portion 25. Of course, any other visually perceptible difference between two colored or contrasting regions can also serve as marking. Instead of the display of a marking or of a contrast difference, provision can likewise alternatively be made for a visually perceptible signal to be output by way of a light-emitting mechanism, for example an LED or some other light source. This can take place in each case in order to signal a positionally correct band arrangement or a non-positionally correct band arrangement to a user of the band strapping appliance. Provision can likewise be made, as a further alternative, for a visually perceptible signal to be output in each case by the strapping appliance both in the event of a positionally correct arrangement of the band in the strapping appliance and in the event of a non-positionally correct arrangement, although these should preferably be different signals.

As is illustrated in FIG. 2, the position of the bearing shaft 19 and the length of the first lever-like portion 21 of the band detection mechanism 20 are coordinated with the position of the closure device, in particular the position of the welding shoe 14, such that the contact lug 23 is arranged behind the closure device—with regard to the band retraction direction 29.

If no strapping band B has been inserted into the strapping appliance, or if a band B has been inserted such that it is not located beneath the hammer-head-like contact lug 23 in the region of the band detection mechanism, the tip of the contact lug 23 rests on a slope 4*a* of the base plate 4 or is located therebehind, without being in contact with the base plate 4 and with the strapping band B arranged in a positionally correct manner. It is only with a side face that the contact lug 23 can be in contact with the side edge, facing in the removal direction, of the strapping band B. Therefore, in this exemplary embodiment, the band detection mechanism 20 has not only the function of detecting a positionally correct arrangement, but also the function of an orientation aid in order to arrange the strapping band in the positionally correct position and to hold it in this position for the duration of strapping creation.

If, however, a strapping band B has not been inserted into the strapping appliance 1 in a positionally correct manner, i.e. not in a manner corresponding to an intended orientation, the tip of the contact lug 23 rests on the strapping band B. Since the strapping band inserted in a non-positionally correct manner is arranged at a distance from the base plate 4, other rotational positions of the band detection mechanism 20 with regard to the axis of rotation 28, determined by the bearing shaft 19, of the band detection mechanism 20 arise for the band detection mechanism arranged on the band, depending on the particular band thickness, compared with the situation in which the band detection mechanism does not rest on the band B. As a consequence, the marking 26 of the band detection mechanism 20 is also located in different rotational positions with regard to the axis of rotation 28 of the first lever-like portion 21.

As is illustrated in FIGS. 1 and 3, inter alia that region of the strapping appliance that is arranged in front of the handle 3 is covered by the housing 2 and enclosed thereby. In the exemplary embodiment, the housing 2 is formed from two assembled housing shells 2*a*, 2*b*, wherein one housing shell 2*a* forms substantially a left-hand half of the housing 2 and the other housing shell 2*b* forms substantially a right-hand half of the housing 2, in each case as seen with regard to a longitudinal direction of the strapping appliance 1. As is likewise illustrated in FIGS. 1 and 3, the housing half 2*a* covering the tensioning wheel 7 has a window 30. This window 30 can be either an open cutout in the housing 2 or a transparent part of the housing 2, for example a transparent plastics part. The window 30 is located immediately in a region within which the second lever-like portion 25 with the marking 26 present thereon executes its pivoting movement about the axis of rotation 28. The window 30 is in this case arranged at a point which, with regard to a rotational position of the marking 26, corresponds to the particular position that the marking 26 takes up when the strapping band B is located beneath the hammer-head-like contact lug 23, or the contact lug 23 is located on the strapping band B. The strapping band B which is located in a non-positionally correct position as a result, as is the case in FIGS. 1 and 2, has, on account of its non-positionally correct position, lifted the contact lug 23 from its original position on the base plate 4 and as a result rotated the band detection mechanism 20 about the axis of rotation 28. The marking 26, which is initially not arranged opposite the window 30, has been moved, by the pivoting movement of the band detection mechanism 20, into a position in which the marking 26 is now located directly opposite the window 30. The marking 26, the color of which differs from the rest of the color of the second portion 25 of the band detection mechanism 20 and preferably also from the color of the housing shell 2*a* (at least in the region of the window 30), has consequently been moved directly behind the window 30 on the inner side of the housing 2.

In the situation in FIG. 4, in which the band is located in the positionally correct position to the side of and next to the contact lug 23, i.e. between the boundary surface 4*b* of the base plate 4 and the contact lug 23, the marking 26 is now not arranged behind the window on account of the movement that has taken place through a particular smaller rotation angle, and is thus not perceptible and discernible in the window from the outside. The positionally correct presence of a strapping band B on or in the strapping appliance is thus signaled in a visually perceptible manner to an operator or user in that the marking 26 does not appear in the window 30. The operator can thus distinguish between a non-positionally correct and a positionally correct arrangement of a strapping band B in the strapping appliance on account of (visually) perceptible different signaling on the strapping appliance.

In order to be able to achieve reliable detection of a strapping band B inserted in a non-positionally correct manner with only one contact lug 23 based on contact with the strapping band, or with a suitable other contact element, it is advantageous for the contact lug 23 to be arranged in substantially one line behind the tensioning wheel 7 and behind the closure device, in this case behind the welding shoe 14. Since, with regard to a non-positionally correct orientation, an obliquely oriented band has a particularly large lateral deflection in a region behind the closure device, this region is particular suitable for distinguishing an incorrect orientation from an orientation in accordance with the intended state, and for detecting this.

What is claimed is:

1. A strapping tool comprising:

a tensioning device comprising a tensioning wheel rotatable to tension a loop of strapping band;

a connecting device actuatable to connect two regions of the loop of strapping band together;

a housing at least partially enclosing the tensioning device and the connecting device, the housing defining a window; and a band-detection device comprising a contact portion and a signaling portion, wherein the signaling portion comprises a marking, wherein the band-detection device is movable between a first position and a second position to move the marking relative to the window of the housing, wherein the band-detection device is positioned such that:

when the strapping band is in a non-positionally correct position, the contact portion of the band-detection device contacts an upper surface of the strapping band and the band-detection device is in the first position, and when the strapping band is in a positionally correct position, the contact portion of the band-detection device does not contact the upper surface of the strapping band and the band-detection device is in the second position.

2. The strapping tool of claim 1, wherein the marking is viewable through the window of the housing when the band-detection device is in the first position and not viewable through the window of the housing when the band-detection device is in the second position.

3. The strapping tool of claim 1, wherein the band-detection device is pivotable between the first and second positions.

4. The strapping tool of claim 3, wherein the contact portion partially defines a band channel that defines the positionally correct position of the strapping band.

5. The strapping tool of claim 4, wherein the band channel extends longitudinally through the tensioning device and the connecting device, and wherein the contact portion is positioned to define a lateral extent of the band channel.

6. The strapping tool of claim 1, wherein the tensioning device is positioned at a front end of the housing, the connecting device is positioned rearward of the tensioning device, and the contact portion of the band-detection device is positioned rearward of the connecting device.

7. The strapping tool of claim 6, further comprising a base plate supporting the tensioning device and the connecting device, wherein the contact portion of the band-detection device engages the base plate when the band-detection device is in the second position.

8. The strapping tool of claim 1, wherein the signaling portion of the band-detection device is laterally offset from the contact portion of the band-detection device.

9. The strapping tool of claim 8, wherein the contact and signaling portions of the band-detection device extend in different directions.

10. The strapping tool of claim 1, further comprising a base plate, wherein the band-detection device further comprises a lever portion pivotably mounted to the base plate so the band-detection device is pivotable between the first and second positions.

11. The strapping tool of claim 10, wherein the contact portion of the band-detection device extends toward the base plate and the signaling portion of the band-detection device extends away from the base plate.

12. The strapping tool of claim 11, wherein the contact portion of the band-detection device engages the base plate when the band-detection device is in the second position.

13. The strapping tool of claim 12, wherein the marking is viewable through the window of the housing when the band-detection device is in the first position and not viewable through the window of the housing when the band-detection device is in the second position.

14. The strapping tool of claim 13, wherein the tensioning device is positioned at a front end of the housing, the connecting device is positioned rearward of the tensioning device, and the contact portion of the band-detection device is positioned rearward of the connecting device.

15. The strapping tool of claim 14, wherein the contact portion partially defines a band channel that defines the positionally correct position of the strapping band.

16. The strapping tool of claim 15, wherein the band channel extends longitudinally through the tensioning device and the connecting device, and wherein the contact portion is positioned to define a lateral extent of the band channel.

17. The strapping tool of claim 10, wherein the base plate comprises a carrier, wherein the lever portion of the band-detection device is pivotably mounted to the carrier.

18. The strapping tool of claim 17, wherein the band-detection device further comprises a connecting portion transverse to the lever portion and extending between the contact portion and the signaling portion, wherein the band-detection device is pivotably mounted to the base plate at a first end of the lever portion, and wherein the contact portion is connected to a second free end of the lever portion that is opposite the first end of the lever portion.

19. The strapping tool of claim 18, wherein the marking is viewable through the window of the housing when the band-detection device is in the first position and not viewable through the window of the housing when the band-detection device is in the second position.

20. The strapping tool of claim 19, wherein a pivot axis of the band-detection device is transverse to a band channel that defines the positionally correct position of the strapping band.

* * * * *